US007905669B2

(12) United States Patent
Fukano

(10) Patent No.: US 7,905,669 B2
(45) Date of Patent: Mar. 15, 2011

(54) MEDIA PROCESSING DEVICE AND DRIVE CONTROL METHOD FOR A MEDIA PROCESSING DEVICE

(75) Inventor: Kazuko Fukano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 644 days.

(21) Appl. No.: 11/981,975

(22) Filed: Nov. 1, 2007

(65) Prior Publication Data

US 2008/0107467 A1 May 8, 2008

(30) Foreign Application Priority Data

Nov. 2, 2006 (JP) ..... 2006-298563

(51) Int. Cl.
*B41J 3/407* (2006.01)
*B41J 29/38* (2006.01)

(52) U.S. Cl. ..... 400/76; 101/43; 101/44; 101/483; 101/484

(58) Field of Classification Search ..... 400/76; 101/43, 44
See application file for complete search history.

(56) References Cited

U.S. PATENT DOCUMENTS

| | | | | |
|---|---|---|---|---|
| 7,070,100 | B2 * | 7/2006 | Davie et al. | 235/440 |
| 7,154,630 | B1 * | 12/2006 | Nimura et al. | 358/1.18 |
| 7,549,626 | B2 * | 6/2009 | Cook et al. | 271/10.02 |
| 2004/0253018 | A1 * | 12/2004 | Mui et al. | 399/110 |
| 2007/0019010 | A1 * | 1/2007 | Katada | 347/7 |
| 2008/0074269 | A1 * | 3/2008 | Torchalski et al. | 340/572.4 |

FOREIGN PATENT DOCUMENTS

| | | | |
|---|---|---|---|
| JP | 2000-141700 | | 5/2000 |
| JP | 2001-191560 | | 7/2001 |
| JP | 2001-322290 | | 11/2001 |
| JP | 2004279451 | A * | 10/2004 |
| JP | 2005-041025 | | 2/2005 |

* cited by examiner

*Primary Examiner* — Daniel J Colilla
(74) *Attorney, Agent, or Firm* — Nutter McClennen & Fish LLP; John J. Penny, Jr.

(57) ABSTRACT

A media processing device has a printer error detection unit 40 that detects ink supply errors, such as the ink end, in the label printer, and a media retraction stacker for removing written media from the media drive, the label printer, and the media transportation path.

17 Claims, 6 Drawing Sheets

MEDIA PROCESSING DEVICE AND DRIVE CONTROL METHOD FOR A MEDIA PROCESSING DEVICE

Priority is claimed under 35 U.S.C. §119 to Japanese Patent Application No. 2006-298563 filed on Nov. 2, 2006, which is hereby incorporated by reference in its entirety.

BACKGROUND OF THE INVENTION

1. Field of Invention

The present invention relates to a media processing device such as a CD/DVD publisher that writes data and prints a label on media such as CD and DVD media, and relates more particularly to a media processing device that can continue writing data even when a problem occurs with the printer that prints the label, and to a drive control method for the media processing device.

2. Description of Related Art

Media processing devices such as CD/DVD publishers are used for producing media such as DVD graduation albums and CDs that are used as magazines inserts. A CD/DVD publisher first supplies blank media from a media supply unit to a media drive that writes data to the medium, and the written medium is then supplied to a printer that prints a label on the medium. The resulting media are then removed one by one from the media exit. When media are mass produced, the finished media are stored sequentially in a media stacker, and the operator removes the finished media from the media stacker as a single batch after the required number of media are finished.

If a data write error occurs in the media drive part or if a print error occurs in the printer part of a CD/DVD publisher, it is necessary to immediately abort or interrupt the data writing operation or the printing operation. The media drive or the printer must then be restored to the normal operating condition and the media that was being processed when the data write error or print error occurred must be removed in order to resume operation.

The likelihood of a print error occurring in the printer is significantly higher than the likelihood of a data write error occurring in the media drive. This is because even if there is no problem with the printer itself, depletion of consumables such as the ink or toner can result in error conditions such as defective printing or being unable to print.

Japanese Unexamined Patent Appl. Pub. JP-A-2000-141700 teaches aborting or interrupting the printing operation of an inkjet printer when the ink supply is depleted until the ink supply is replenished.

Japanese Unexamined Patent Appl. Pub. JP-A-2005-41025 teaches setting the remaining ink level at which the ink supply is considered nearly depleted, that is, when an ink near-end state is detected, in an image printing device to the amount of ink required to print one page of the printing paper, completing printing the page that was being printed when the ink near-end state was detected while printing, and then stopping or pausing the printing operation.

Japanese Unexamined Patent Appl. Pub. JP-A-2001-191560 teaches to continue printing using the remaining color inks after a no-ink state is detected.

When mass-producing media such as graduation albums, the CD/DVD publisher commonly runs 24 hours a day producing the CDs, DVDS, or other media. The CD/DVD publisher is also commonly unattended at night, and if the printer runs out of ink while the system is unattended, the media production operation (including data writing and label printing) stops or pauses until the ink supply is replenished. Operation may therefore be interrupted for a long time due to a printer error such as there being no ink when the publisher is unattended. In addition, if the operator is working away from the CD/DVD publisher, the operator may not notice that the ink ran out or a printing error occurred, and operation may thus be interrupted in the same way as when the publisher is unattended.

Media production can become significantly delayed when this happens. Furthermore, if the time the CD/DVD publisher operation is stopped or paused becomes long, productivity drops significantly while wasted power consumption increases. In order to avoid running out of ink when mass producing media, it is necessary to regularly check the remaining ink level and add ink or replace the ink cartridges with new cartridges. Performing such tasks whenever is a bother, increases the ink cartridge replacement frequency, and wastes ink.

SUMMARY OF THE INVENTION

A media processing device and a drive control method for a media processing device according to the present invention do not require completely stopping or interrupting the processing operation when a problem such as an out-of-ink error occurs in the printer.

A drive control method for a media processing device according to a first aspect of at least one embodiment of the invention has steps including supplying media from a media supply unit to a media drive; the media drive writing data to the media; supplying written media after data writing to a printer; the printer printing a label on the written media; storing the finished media after label printing in a finished media stacker; diverting written media after data writing by the media drive to a prescribed retraction location after a printer error is detected; and continuing to write data to new media supplied from the media supply unit to the media drive, and divert written media to the retraction location until the printer returns to normal.

When a problem occurs in the printer, this aspect of the invention diverts written media to a retraction location. Because written media are not left inside the media drive, inside the printer, or on the transportation path, new media can be supplied to the media drive and data can be written on the new media. Writing data to media can therefore continue even if a printer problem such as running out of ink occurs because the media processing operation of the media processing device is not completely stopped or interrupted.

It generally takes approximately 150 seconds for a media drive to write a CD, and approximately 600 seconds to write a DVD. The label printing speed of the printer even at high resolution is approximately 40 seconds per disc. Lost processing time can therefore be significantly reduced compared with stopping or interrupting the entire media processing operation of the media processing device when a printer error occurs if writing data to the media is not stopped and continues.

The retraction location for written media after a print error occurs can be the finished media stacker or a media retraction stacker disposed separately from the finished media stacker.

If the retraction location is a media retraction stacker, the written media stored in the media retraction stacker can be removed and carried to the printer after the printer is returned to the normal operating condition, the printer can print the labels, and the unfinished media can be completed. Processing after the printer returns to normal can therefore continue efficiently.

If a printer error is detected after the printer starts printing to a written medium, this aspect of the invention unconditionally ends the printing operation of the printer, and removes and discharges the partially printed written medium from the printer to a defective media stacker.

Unlike the unprinted media that have been written and diverted to the media retraction stacker, media with such print defects cannot be used. Therefore, by discharging media with print defects to a different location than the unprinted media and the finished media, sorting the print defect media from the other media in order to dispose of the defectively printed media is not necessary and processing is more efficient after the printer returns to normal.

Frequently occurring ink supply problems, particularly depletion of ink in the printer (an ink end state) and near-depletion of ink (an ink near-end state) when the amount of ink remaining in the printer drops below a prescribed level, can be detected as printer errors. In this case, if an ink near-end state is detected after the printer starts printing on a written medium, the printing operation of the printer is preferably not unconditionally ended and continues in order to finish printing the written medium.

Further preferably, after a written medium for which the printing operation was completed after an ink near-end state was detected is removed from the printer and stored in the finished media stacker, written media after data is written by the media drive are diverted to the retraction location and are not transported to the printer.

If the remaining ink quantity of the printer that is used for detecting an ink near-end state is greater than or equal to the amount of ink required to print a label on one medium, printing on the medium can continue to completion if an ink near-end state is detected while the medium is being printed. This remaining ink level can be calculated from the print data.

Yet further preferably, a warning is issued when a printer error is detected in order to inform the operator.

Yet further preferably, because media that caused a data write error and print defect media cannot be used, media that resulted in a write error are preferably discharged for easier disposal to a defective media stacker that is separate from where the successfully written media and finished media are stored.

The drive control method for a media processing device according to at least one embodiment of the present invention can be realized using the hardware and firmware of the media processing device. In order to execute the drive control method of the invention on a media processing device without complicating the firmware and hardware arrangement of the media processing device, the media processing device can be driven and controlled externally through a communication connection. More specifically, using an application program or driver software on the drive control device side to receive status information describing the operating state of the hardware in the media processing device, the media processing device can be controlled to operate according to the drive control method of the invention.

Another aspect of at least one embodiment of the invention is a media processing device that has a media drive for writing data to media; a printer for printing a label on the media; a finished media stacker for storing the finished media after data writing and label printing are completed; a media retraction stacker for diverting media; a media transportation mechanism for transporting media; and a printer error detector for detecting printer problems. The media transportation mechanism diverts written media after data is written by the media drive to the media retraction stacker after a printer problem is detected.

Further preferably, the media processing device also has a defective media stacker. If a printer error is detected after the printer starts printing to a written medium, the printer unconditionally ends the printing operation, and the media transportation mechanism discharges the partially printed written medium from the printer to the defective media stacker.

If the printer error detector detects ink end states of the printer and ink near-end states of the printer in which the amount of ink remaining in the printer is less than a prescribed level, and the ink near-end state is detected after the printer has started printing to a written medium, the printer can continue printing instead of unconditionally ending the printing operation, and the media transportation mechanism can store the finished media after printing ends to the finished media stacker. If the printer detects the ink end after printing on a written medium has started, the printer unconditionally stops printing and the media transportation mechanism discharges the partially printed written medium from the printer to the defective media stacker.

Further preferably, the media processing device also has a warning indicator that issues a warning when a printer error is detected.

Yet further preferably, the media processing device also has a data write error detector that detects data writing errors by the media drive, and the media transportation mechanism discharges write defect media from which a data write error was detected to the defective media stacker.

EFFECT OF THE INVENTION

When a problem occurs in the printer, the invention causes written media to be diverted to a media retraction stacker, and no written media are left in the media drive, the printer, or the media transportation path. New media can therefore be supplied to the media drive and the data writing operation can continue. Because there is no need to stop or interrupt the time-consuming data writing operation, the loss of media production time can be greatly reduced compared with completely stopping or interrupting operation when a printer error occurs.

Other objects and attainments together with a fuller understanding of the invention will become apparent and appreciated by referring to the following description and claims taken in conjunction with the accompanying drawings.

DESCRIPTION OF PREFERRED EMBODIMENTS

Preferred embodiments of a media processing device according to the present invention are described below with reference to the accompanying figures.

Description of General Configuration

Figure 1:
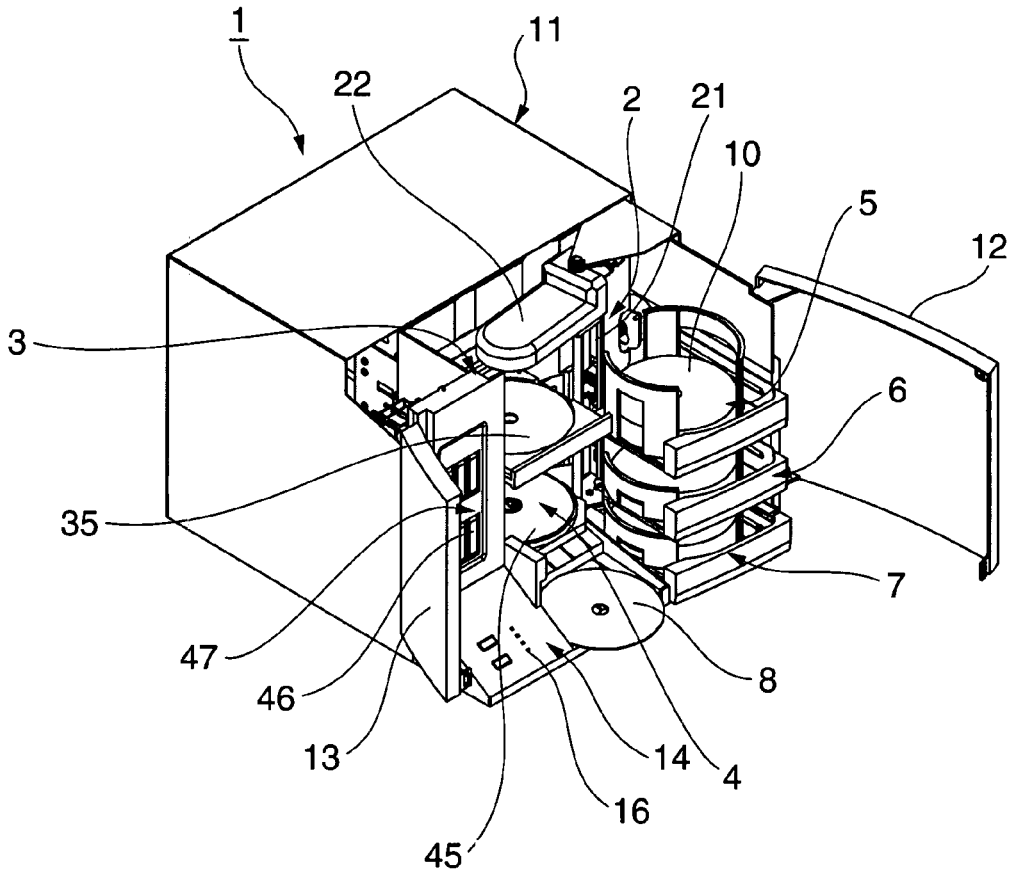
FIG. 1 is an oblique view of a CD/DVD publisher according to the present invention.

FIG. 1 is an oblique view showing a CD/DVD publisher according to a preferred embodiment of the invention. So that the internal arrangement can be more easily understood, the CD/DVD publisher is shown with the front doors open and a part of the top panel of the case removed. This embodiment of the invention is described using an inkjet printer by way of example.

The CD/DVD publisher 1 consecutively writes data and then prints a label on CD, DVD, or similar media, and has a media transportation mechanism 2 for transporting the media, a media drive 3 for writing data to the media, and a label printer 4 for printing labels on the media. The CD/DVD publisher 1 also has a blank media stacker 5 (media supply unit), a finished media stacker 6, a media retraction stacker 7, and a defective media stacker 8. The blank media stacker 5 stores the blank media 10 that are supplied to the media drive 3. The finished media stacker 6 stores the completed media after data writing and label printing are completed. The media retraction stacker 7 is used for removing media from the media transportation path.

More specifically, the CD/DVD publisher 1 has a case 11 and doors 12, 13 that can open to the right and left attached to the front of the case 11. At the bottom of the left door 13 is an operating panel 14 that faces towards the front. A start switch 15 and a warning display unit 16 (warning indicator) are disposed on the operating panel 14. The warning display unit 16 is composed of LEDs that blink when a problem occurs in the label printer 4, for example, to inform the operator.

Stacked from top to bottom behind the right side door 12 inside the case 11 are the blank media stacker 5, the finished media stacker 6, and the media retraction stacker 7. Each of the media stackers 5, 6, and 7 stores the media in a vertical stack. The media stackers 5, 6, and 7 can be pulled out forward by opening the door 12 so that blank media can be loaded into the blank media stacker 5 when pulled out, and the stored media can be removed from the finished media stacker 6 and the media retraction stacker 7 when pulled out.

The defective media stacker 8 is disposed at the bottom in the front center part of the case 11. The defective media stacker 8 is a tray-type stacker with a round recess into which rejected media are discharged when a printing error or data write error occurs.

The media transportation mechanism 2 is located behind the media stackers 5, 6, and 7. The media transportation mechanism 2 has a vertical guide shaft 21 and a media carrier 22 that is attached to the vertical guide shaft 21. The media carrier 22 can move up and down along the vertical guide shaft 21 and can pivot on the vertical guide shaft 21. The media transportation mechanism 2 transports the media between the media drive 3, the label printer 4, and the media stackers 5, 6, 7 and 8 by combining the elevator and pivoting actions of the media carrier 22.

The media drive 3 is disposed towards the top of the publisher 1 and the label printer 4 is disposed below the media drive 3 inside the case 11 at a position behind the front center part of the case 11. FIG. 1 shows the media tray 35 of the media drive 3 and the media tray 45 of the label printer 4 pulled out to the forward position. When the media trays 35 and 45 are pulled out to this forward position, they are in the media transfer position for transferring media between the media transportation mechanism 2 and the media drive 3 and label printer 4.

A cartridge loading unit 47 in which a plurality of ink cartridges 46 that supply ink to the label printer 4 are loaded is disposed behind the left side door 13 inside the case 11. The ink cartridge 46 can be replaced easily from the front with the left door 13 open.

Figure 2:
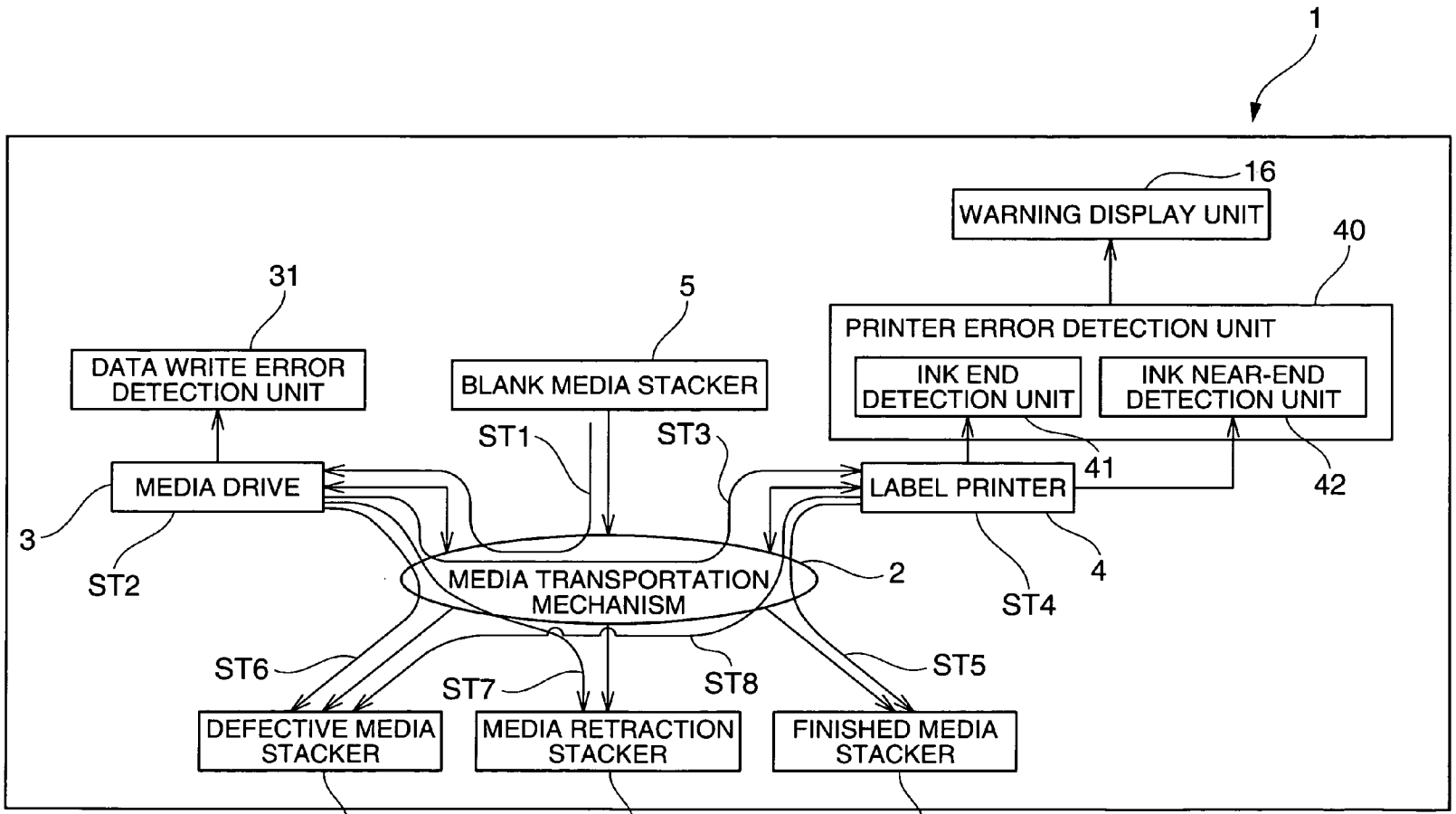
FIG. 2 is a function block diagram of the CD/DVD publisher.

FIG. 2 is a function block diagram showing the main parts of the CD/DVD publisher 1. The main functions of the CD/DVD publisher 1 are described below with reference to this figure.

First, the media transportation mechanism 2 sequentially supplies blank media 10 from the blank media stacker 5 to the media drive 3 (ST1), and the media drive 3 then writes prescribed data to the blank medium (ST2). When data writing ends, the media transportation mechanism 2 carries the written medium to the label printer 4 (ST3), and the label printer 4 prints a label (ST4). When printing ends, the completed medium is stored in the finished media stacker 6 by the media transportation mechanism 2 (ST5). This sequence of steps repeats for the specified number of media or until no blank media 10 are stored in the blank media stacker 5.

The CD/DVD publisher 1 also has a data write error detection unit 31 for detecting data write errors that occur in the media drive 3. When the data write error detection unit 31 detects a data write error, the media transportation mechanism 2 discharges the medium that was being written when the write error was detected (referred to as "write defect media") to the defective media stacker 8 (ST6) instead of carrying the medium from the media drive 3 to the label printer 4.

The CD/DVD publisher 1 also has a printer error detection unit 40 for detecting errors that occur in the label printer 4. The printer error detection unit 40 in this embodiment of the invention detects ink supply errors in the label printer 4. The printer error detection unit 40 includes an ink end detection unit 41 and a ink near-end detection unit 42. The ink end detection unit 41 detects the actual end of ink, that is, when the ink supply has been completely depleted. The ink near-end detection unit 42 detects the ink near-end state, that is, when the ink level has dropped below a prescribed level and is nearly depleted. If an ink near-end or ink end state is detected before the media transportation mechanism 2 carries a written medium from the media drive 3 to the label printer 4, the written medium is stored in the media retraction stacker 7 instead of being supplied to the label printer 4 (ST7).

If an ink near-end state is detected after the media transportation mechanism 2 carries the written medium to the label printer 4 and the label printer 4 starts printing the label, the label printer 4 displays a warning that the ink is near the end on the warning display unit 16 and continues printing. If an ink end is then detected before printing to the written medium that is being printed ends, the ink end state is displayed on the warning display unit 16 and printing is aborted. The media transportation mechanism 2 then discharges the partially printed written medium (referred to as "print defect media") to the defective media stacker 8.

When a problem occurs with the label printer 4, written media are thus diverted to the media retraction stacker 7 so that written media are not left on the media transportation path inside the media drive 3 or the label printer 4. As a result, a new blank medium 10 can be supplied to the media drive 3 and the time-consuming process of writing data to the blank media 10 can continue. Lost production time can therefore be minimized when a problem occurs with the label printer 4.

Description of the Operating Process

Figure 3:
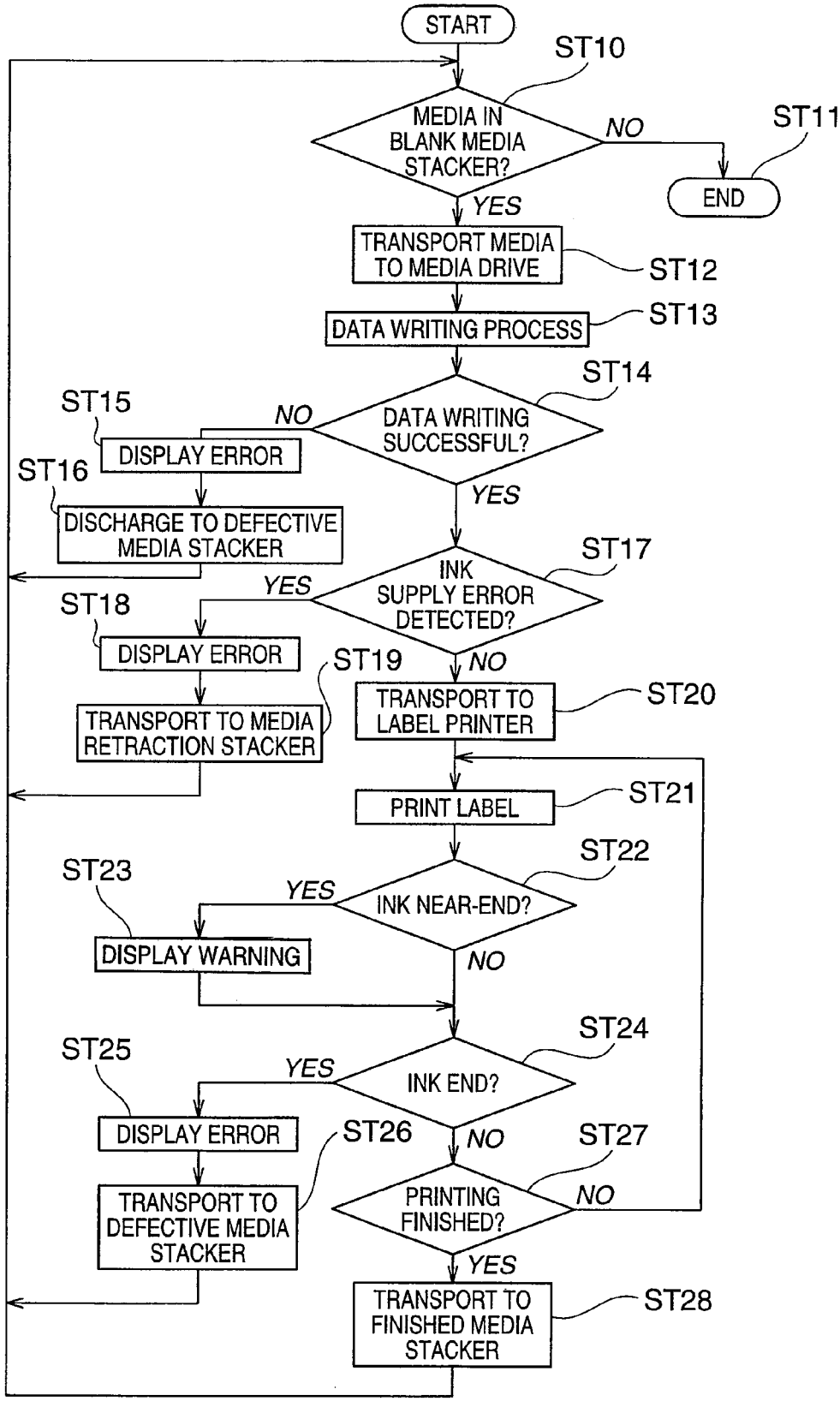
FIG. 3 is a flow chart describing the processing operation of the CD/DVD publisher.

FIG. 3 is a flow chart describing the operation of the media production process of the CD/DVD publisher 1. The media production operation is described with reference to this flow chart.

First, in step ST10, the media transportation mechanism 2 checks if blank media 10 are stored in the blank media stacker 5. Control goes to step ST11 and the media production process stops if there are no blank media 10.

If a blank medium 10 is in the blank media stacker 5, control goes to step ST12 and the media transportation mechanism 2 carries a blank medium 10 from the blank media stacker 5 to the media tray 35 that is discharged from the media drive 3 to the media transfer position.

When a medium is received, the media drive 3 stores the medium in the media tray 35 and starts writing data in step ST13.

Whether the data write error detection unit 31 detects a data writing error is monitored during the data writing process. If a data writing error is detected (step ST14 returns No), that a write error occurred is displayed on the warning display unit 16 in step ST15, the media transportation mechanism 2 discharges the medium that was being written when the write error was detected to the defective media stacker 8 in step ST16, and control returns to step ST10.

If the data write error detection unit 31 did not detect a data write error (step ST14 returns Yes), that is, if data is written normally, step ST17 checks the ink supply error status of the printer error detection unit 40. This step ST17 considers both an ink end state detected by the ink end detection unit 41 and an ink near-end state detected by the ink near-end detection unit 42 to be an ink supply error.

If step ST17 detects an ink supply error, the error is reported on the warning display unit 16 in step ST18, the media transportation mechanism 2 stores the written medium in the media retraction stacker 7 in step ST19, and control returns to step ST10.

The media stored in the media retraction stacker 7 in step ST19 are unprinted written media, that is, media to which data has been successfully written but on which a label has not been printed.

If an ink supply error is not detected in step ST17, the media transportation mechanism 2 carries the written medium to the media tray 45 in the media transfer position of the label printer 4 in step ST20. When a written medium is received, the label printer 4 prints a label in step ST21. The printer error detection unit 40 checks for an ink end or ink near-end state while the label is being printed.

If the ink near-end detection unit 42 detects an ink near-end state in step ST22 during label printing, an ink near-end warning is displayed on the warning display unit 16 in step ST23. In this case, the label printer 4 continues label printing without interruption. If the ink end detection unit 41 detects the ink end in step ST24 during media printing, control goes to step ST25. If the remaining ink level in the printer when an ink near-end state is detected is greater than or equal to the amount of ink required to print a complete label on one medium, printing to the written medium that is being printed when an ink near-end state is detected during printing can be completed. This remaining ink level can be calculated from the print data.

The ink end state is then displayed on the warning display unit 16 in step ST25. Label printing by the label printer 4 is also unconditionally interrupted. The media transportation mechanism 2 then discharges the defectively printed medium to the defective media stacker 8 in step ST26, and control returns to step ST10.

If an ink end is not detected in step ST24, steps ST21 to ST24 repeat until step ST27 determines that label printing ended.

When step ST27 confirms that label printing ended, the media transportation mechanism 2 stores the printed finished medium to the finished media stacker 6 in step ST28 and control then returns to step ST10.

If the printer error detection unit 40 detects an ink end state or an ink near-end state before a written medium is carried to the label printer 4 in this embodiment of the invention, the media transportation mechanism 2 stores the written medium to the media retraction stacker 7 in step ST19. Because the medium does not pass through the label printer 4, the time required to divert the written medium can be shortened.

Furthermore, if an ink near-end state is detected during label printing, the media printing process can continue until the ink end is detected, and the number of finished media can therefore be increased using the remaining ink.

In addition, if the ink end is detected during label printing by the label printer 4, the partially printed medium is discharged as "no good" to the defective media stacker 8. Because such print defect media and write defect media that produced a write error cannot be used, both write defect media and print defect media can be destroyed in a single batch if they are stored in the defective media stacker 8.

In addition, the media retraction stacker 7 stores media that have been written but are still unprinted. After the label printer 4 is restored to the normal printing condition, the written media that were diverted to the media retraction stacker 7 can be delivered by the media transportation mechanism 2 to the label printer 4 and the label printer 4 can print the label.

An ink near-end state and an ink end state are detected as the ink supply errors in this embodiment of the invention, but the absence of an ink cartridge 46 in the cartridge loading unit 47 can also be detected as an ink supply error. Problems detected by the printer error detection unit 40 are also not limited to ink supply problems, and the printer error detection unit 40 can also be configured to detect hardware problems. All such problems can be handled in the same way as when the ink end is detected.

This embodiment carries blank media 10 from the blank media stacker 5 for data writing, but the supplied media are not limited to blank media 10. More particularly, write-once and rewritable media that already have data written to part of the data writing area can be stored in the blank media stacker 5 so that additional data can be written.

The defective media stacker 8 is also a tray-type discharge stacker with a round recess in this embodiment of the invention, but the defective media stacker 8 can be a storage stacker configured in the same way as the other stackers.

Furthermore, an inkjet printer is used as the label printer 4 in this embodiment, but the label printer can be a laser printer or other type of printer that prints labels using toner.

Embodiment 2

The media drive 3, the label printer 4, and the media transportation mechanism 2 in the CD/DVD publisher 1 described above are automatically identified and controlled by firmware in the CD/DVD publisher 1, but a drive control device communicably connected to the CD/DVD publisher 1 can control driving the media drive 3, the label printer 4, and the media transportation mechanism 2 to publish media as described above. In this case an application program or driver software provided on the drive control device side issues commands to the media processing device and monitors status data received from the media processing device that denotes the operating state of the hardware to control driving the media processing device.

Figure 4:
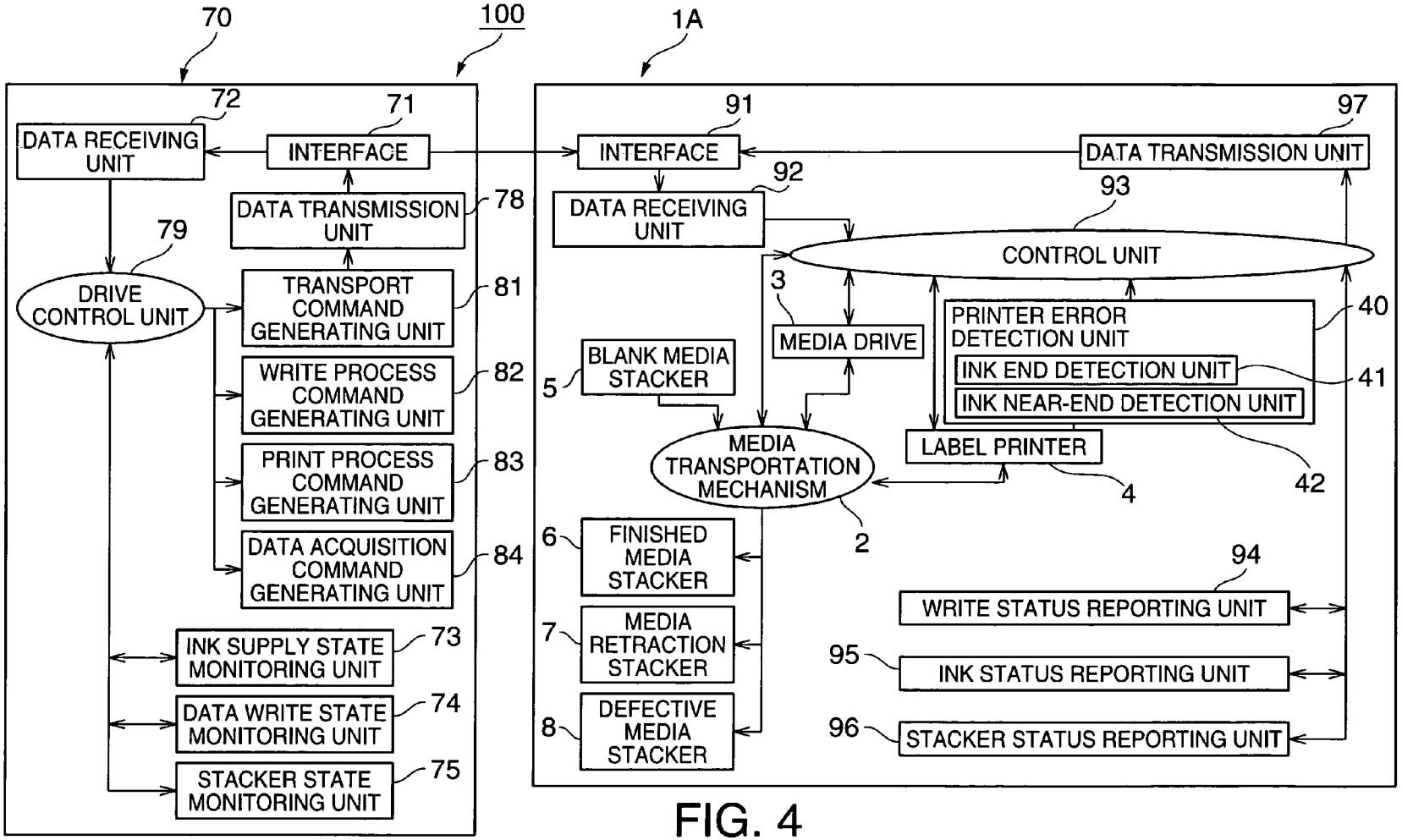
FIG. 4 is a block diagram of a media production system according to the present invention.

FIG. 4 is a block diagram showing the arrangement of a media production system according to this aspect of the invention. This media production system 100 has a drive control device 70 and a CD/DVD publisher 1A. The drive control device 70 is a computer that is connected so that it can communicate with the CD/DVD publisher 1A, and runs an application program for controlling driving the CD/DVD publisher 1A. The basic arrangement of the CD/DVD publisher 1A is the same as the CD/DVD publisher 1 in the first embodiment, like parts are identified by like reference numerals and further description thereof is omitted.

The drive control device 70 has an interface 71, a data receiving unit 72 for processing information received through the interface 71, an ink supply state monitoring unit 73, a data write state monitoring unit 74, a stacker state monitoring unit 75, command generating units 81 to 84, a data transmission unit 78 for sending the generated control commands, and a drive control unit 79 for controlling these other parts.

The interface 71 is used for exchanging control commands and status data with the CD/DVD publisher 1A.

The ink supply state monitoring unit 73 monitors the ink supply error status of the label printer 4 in the CD/DVD publisher 1A.

The data write state monitoring unit 74 monitors data write errors in the media drive 3.

The stacker state monitoring unit 75 monitors how many media remain in the blank media stacker 5, for example.

The command generating units 81 to 84 generate the control commands for controlling driving the CD/DVD publisher 1A.

The command generating units 81 to 84 are a transport command generating unit 81, a write process command generating unit 82, a print process command generating unit 83, and a data acquisition command generating unit 84.

The transport command generating unit 81 outputs control commands to drive the media transportation mechanism 2 and control transporting media from one specified position to another specified position.

The write process command generating unit 82 generates write commands for controlling driving the media drive 3 to write specific data to the blank media 10.

The print process command generating unit 83 generates print commands for controlling driving the label printer 4 to print a specific label on the written media.

The data acquisition command generating unit 84 generates data acquisition commands for getting various information to monitor the operation of the CD/DVD publisher 1A.

The CD/DVD publisher 1A has an interface 91, a data receiving unit 92, status reporting units 94 to 96, a data transmission unit 97 for sending generated status data, and a control unit 93 for controlling these other units as well as the media transportation mechanism 2, the media drive 3, and the label printer 4.

The interface 91 is used for exchanging control commands and status data with the drive control device 70.

The data receiving unit 92 processes information received through the interface 91.

The status reporting units 94 to 96 produce and report information about the CD/DVD publisher 1A to the drive control device 70.

The status reporting units 94 to 96 include a write status reporting unit 94 for reporting data write errors detected by the data write error detection unit 31, an ink status reporting unit 95 for reporting ink supply errors including ink end and ink near-end states detected by the printer error detection unit 40, and a stacker status reporting unit 96 for reporting how many media remain in the blank media stacker 5, for example.

Figure 5:
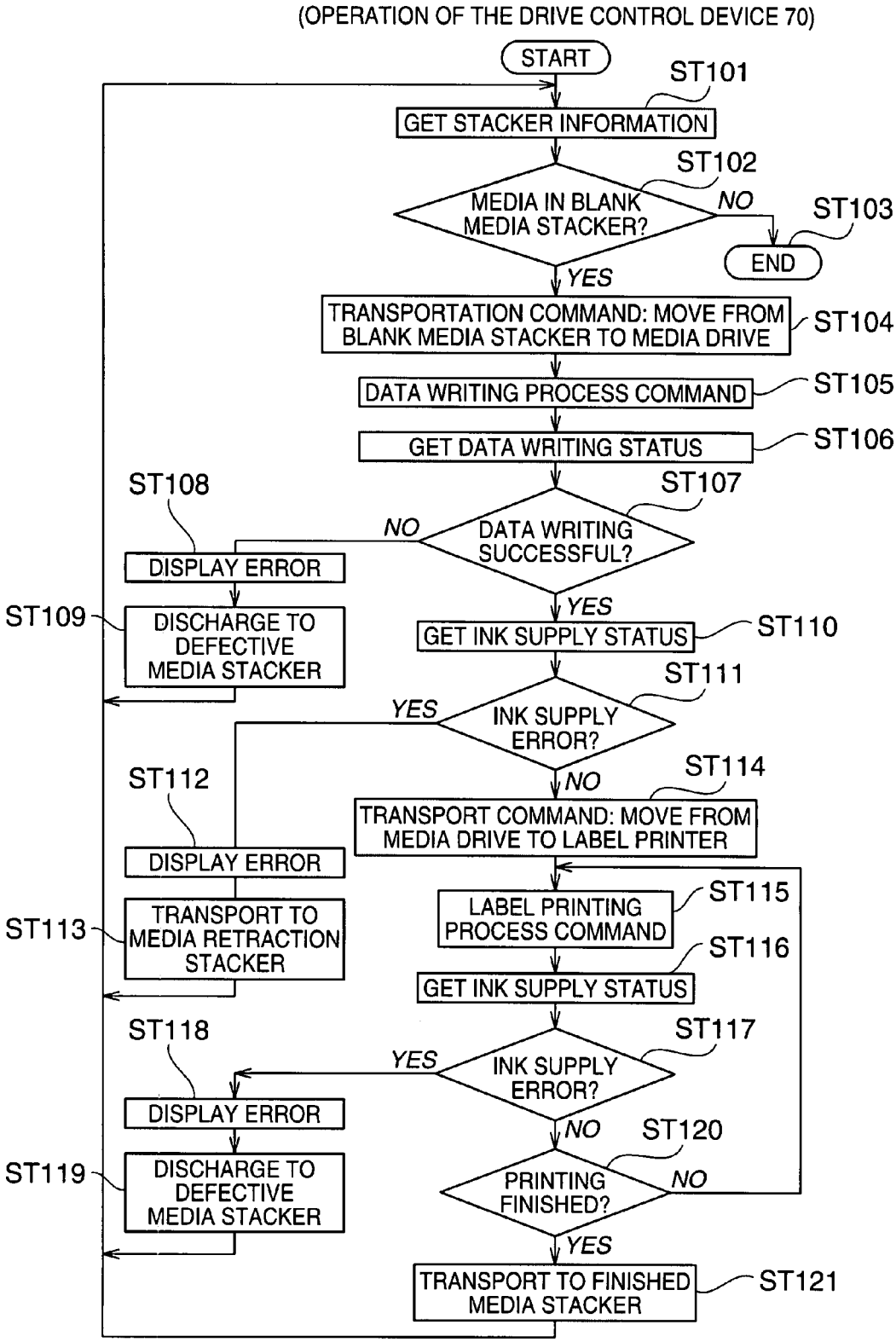
FIG. 5 is a flow chart describing the control operation of the drive control device in the media production system.

FIG. 5 is a flow chart describing the operation of the drive control device 70. The operation is described below according to this flow chart. The stacker state monitoring unit 75 first gets the number of blank media 10 stored in the blank media stacker 5 in step ST101.

If step ST102 determines there are no blank media 10, control goes to step ST103 and the media production process ends. If a blank medium 10 is available, control goes to step ST104 and the transport command generating unit 81 generates a transportation command for carrying a blank medium 10 from the blank media stacker 5 to the media drive 3, and the command is sent by the data transmission unit 78.

In step ST105 the write process command generating unit 82 generates a write process command for writing data to the blank medium 10 and the command is sent by the data transmission unit 78. In step ST106 the data write state monitoring unit 74 gets data write error status data and control goes to step ST107.

If a data write error is detected in step ST107, the data write error is reported on the display, for example, of the drive control device 70 in step ST108. Then in step ST109, the transport command generating unit 81 generates a transportation command to move the write defect media to the defective media stacker 8, the command is sent by the data transmission unit 78, and control returns to step ST101.

If a data write error is not detected in step ST107, the ink supply state monitoring unit 73 receives the ink supply error status data in step ST110 and control goes to step ST111. Both an ink end and an ink near-end state are considered to be an ink supply error in step ST111.

If an ink supply error is detected in step ST111, the ink supply error is reported on the display of the drive control device 70, for example, in step ST112. Then in step ST113 the transport command generating unit 81 generates a transportation command to store the written medium in the media retraction stacker 7, the command is sent, and control then returns to step ST101.

If an ink supply error is not detected in step ST111, the transport command generating unit 81 generates a transportation command to carry the written medium from the media drive 3 to the label printer 4 and sends the command with the data transmission unit 78 in step ST114. The print process command generating unit 83 then generates a print process command for printing a label on the written medium and the data transmission unit 78 sends the command in step ST115. The printer error detection unit 40 detects ink end and ink near-end states during label printing.

The ink supply state monitoring unit 73 gets the ink supply error status data in step ST116, and control goes to step ST117. This embodiment of the invention handles both ink end and ink near-end states as an ink supply error.

If an ink supply error is detected in step ST117, control goes to step ST118 and the printing error is reported on the display of the drive control device 70, for example. The transport command generating unit 81 then generates a transportation command to carry the print defect media to the defective media stacker 8 and the command is sent by the data transmission unit 78 in step ST119, and control returns to step ST101.

If an ink supply error is not detected in step ST117, steps ST115 to ST117 repeat until step ST120 determines that label printing ended. When step ST120 confirms that label printing ended, control goes to step ST121, the transport command generating unit 81 generates a transportation command to transport the finished medium from the label printer 4 to the finished media stacker 6, the data transmission unit 78 sends the command, and control returns to step ST101.

Figure 6:
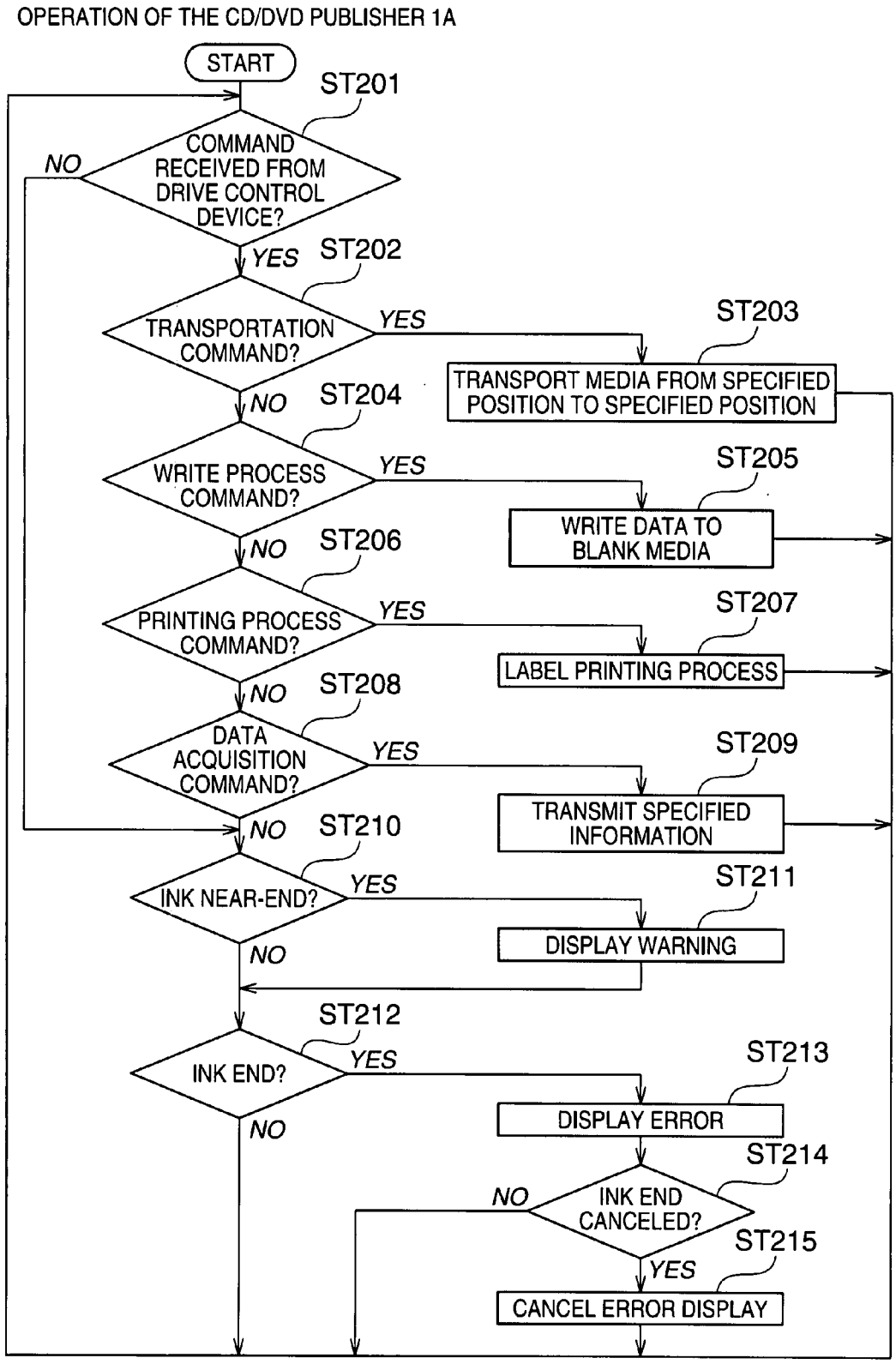
FIG. 6 is a flow chart describing the processing operation of the CD/DVD publisher in the media production system.

FIG. 6 is a flow chart describing the operation of the CD/DVD publisher. The operation is described below with reference to this flow chart.

In step ST201 the CD/DVD publisher 1A checks for a control command from the drive control device 70. If a control command from the drive control device 70 was received, control goes to step ST202; if a control command was not received, control goes to step ST210.

If a media transportation command was received (step ST202 returns Yes), control goes to step ST203, the media transportation mechanism 2 operates, and control returns to step ST201.

If the received transportation command was generated by the drive control device 70 in step ST104, operation of the media transportation mechanism 2 transports a blank medium 10 from the blank media stacker 5 to the media drive 3.

If the transportation command was generated in step ST109, the media transportation mechanism 2 transports the write defect media from the media drive 3 to the defective media stacker 8.

If the transportation command was generated in step ST113, the media transportation mechanism 2 transports the written medium from the media drive 3 to the media retraction stacker 7.

If the transportation command was generated in step ST114, the media transportation mechanism 2 transports the written medium from the media drive 3 to the label printer 4.

If the transportation command was generated in step ST119, the media transportation mechanism 2 transports the print defect media from the label printer 4 to the defective media stacker 8.

If the transportation command was generated in step ST121, the media transportation mechanism 2 transports the finished medium from the label printer 4 to the finished media stacker 6.

If the received command was a write process command generated by the drive control device 70 in step ST106 (step ST204 returns Yes), control goes to step ST205, the media drive 3 is driven to write the prescribed data, and control returns to step ST201.

If the received command was a print process command generated by the drive control device 70 in step ST115 (step ST204 returns Yes), control goes to step ST206, the label printer 4 is driven to print a label, and control returns to step ST201.

If the received command was a data acquisition command generated by the data acquisition command generating unit 84 of the drive control device 70 (step ST208 returns Yes), control goes to step ST209, the requested data is transmitted, and control returns to step ST201.

If the ink near-end detection unit 42 detects an ink near-end state in step ST210, the warning display unit 16 displays an ink near-end warning in step ST211. Control then goes to step ST212 to check for an ink end state.

If the ink end detection unit 41 detects an ink end state in step ST212, the warning display unit 16 displays an ink end warning in step ST213. If the ink end state continues in step ST214, control returns to step ST201. However, if the operator has replenished the ink supply or replaced the ink cartridge 46 so that the ink end state has ended in step ST214, the warning displayed on the warning display unit 16 is cleared in step ST215 and control returns to step ST201.

The media processing system according to this second embodiment of the invention affords the same effect as the first embodiment.

In addition, because the CD/DVD publisher 1A operates in response to commands from the drive control device 70, autonomic control of the CD/DVD publisher 1A and the related configuration process are unnecessary, and the firmware provided in the CD/DVD publisher 1A can be simplified.

Furthermore, because the destination of the media transportation mechanism 2 can be freely controlled by transportation commands from the drive control device 70, which stackers are used as the blank media stacker 5, the finished media stacker 6, the defective media stacker 8, and the defective media stacker 8 can be easily changed.

This embodiment of the invention unconditionally discharges to the defective media stacker 8 written media that were being printed when an ink near-end state is detected during label printing as print defect media, but printing can continue until an ink end state is detected as in the first embodiment of the invention. The process is changed in this case according to a control command from the drive control device 70.

Specific previously prepared data is written to the blank media 10 by the CD/DVD publisher 1A in this embodiment of the invention, but the write data can be prepared on the drive control device 70 side and transferred to the CD/DVD publisher 1A before the write process command is sent and the media production process is started. Data for the labels printed by the label printer 4 can be processed in the same way.

Furthermore, by providing a stacker status reporting unit 96 that returns the number of blank media 10 in the blank media stacker 5, the number of blank media 10 can be constantly displayed on the display of the drive control device 70 based on this information. The number of media in each of the stackers other than the blank media stacker 5 can also be detected and constantly displayed.

An ink near-end state and an ink end state are detected as the ink supply errors in this embodiment of the invention, but the absence of an ink cartridge 46 in the cartridge loading unit 47 can also be detected as an ink supply error. Problems detected by the printer error detection unit 40 are also not limited to ink supply problems, and the printer error detection unit 40 can also be configured to detect hardware problems. All such problems can be handled in the same way as when the ink end is detected.

In addition, if the ink end is detected during label printing by the label printer 4, the partially printed medium is discharged as no good to the defective media stacker 8. Because such partially printed print defect media and write defect media that produced a write error cannot be used, both write defect media and print defect media can be destroyed in a single batch if they are stored in the defective media stacker 8.

This embodiment carries blank media 10 from the blank media stacker 5 for data writing, but the supplied media are not limited to blank media 10. More particularly, write-once and rewritable media that already have data written to part of the data writing area can be stored in the blank media stacker 5 so that additional data can be written.

Furthermore, an inkjet printer is used as the label printer 4 in this embodiment, but the label printer can be a laser printer or other type of printer that prints labels using toner.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A drive control method for a media processing device comprising:
supplying media from a media supply unit to a media drive;
writing data to the media;
supplying written media after data writing to a printer;
printing a label on the written media;
storing the finished media after label printing in a finished media stacker;
diverting written media after data writing by the media drive to a prescribed retraction location after a printer error is detected; and
continuing to write data to new media supplied from the media supply unit to the media drive, and diverting written media to the retraction location until the printer returns to normal.

2. The drive control method for a media processing device described in claim 1, wherein:
the retraction location is the finished media stacker or a media retraction stacker disposed separately from the finished media stacker.

3. The drive control method for a media processing device described in claim 2, further comprising:
after the printer returns to a normal printing condition, transporting written media that are stored in the media retraction stacker to the printer,
printing a label, and
storing the finished media after label printing in the finished media stacker.

4. The drive control method for a media processing device described in claim 1, wherein:
if an ink end printer error is detected after the printer starts printing to a written medium the printing operation of the printer ends unconditionally, and
the partially printed written medium is removed from the printer and discharged to a defective media stacker.

5. The drive control method for a media processing device described in claim 1, wherein:
if an ink near-end state in which the ink remaining in the printer is less than or equal to a prescribed level is detected after the printer starts printing on a written medium, the printing operation of the printer is not unconditionally ended and continues.

6. The drive control method for a media processing device described in claim 5, wherein:
after a written medium for which the printing operation was completed after an ink near-end state was detected is removed from the printer and stored in the finished media stacker,
written media after data is written by the media drive are diverted to the retraction location and are not transported to the printer.

7. The drive control method for a media processing device described in claim 5, wherein:
said prescribed level is greater than or equal to the amount of ink required to print a label on one medium.

8. The drive control method for a media processing device described in claim 1, further comprising:
issuing a warning when a printer error is detected.

9. The drive control method for a media processing device described in claim 1, further comprising:
detecting data write errors by the media drive; and
discharging write defect media with which a data write error was detected to the defective media stacker.

10. A drive control device for a media processing device comprising:
a controller that controls and drives a media processing device using the method described in any of claims 1 to 9, wherein:
the media processing device is driven and controlled externally over a communication connection.

11. The drive control method for a media processing device described in claim 1, further comprising:
displaying a number of media in said media supply unit, said finished media stacker, and said retraction location.

12. The drive control method for a media processing device described in claim 1, further comprising detecting an absence of an ink cartridge.

13. A media processing device comprising:
a media drive for writing data to media;
a printer for printing a label on the media;
a finished media stacker for storing the finished media after data writing and label printing are completed;
a media retraction stacker for retracting media;
a media transportation mechanism for transporting media; and
a printer error detector that detects printer problems;
wherein the media transportation mechanism diverts substantially all written media after data is written by the media drive to the media retraction stacker in response to a printer problem that is detected until the printer returns to normal.

14. The media processing device described in claim 13, further comprising:
a defective media stacker;
wherein if an ink end printer error is detected after the printer starts printing to a written medium,
the printer unconditionally ends the printing operation, and
the media transportation mechanism discharges the partially printed written medium from the printer to the defective media stacker.

15. The media processing device described in claim 13, further comprising:
a defective media stacker;
wherein the printer error detector detects an ink end state of the printer, and an ink near-end state in which the ink remaining in the printer is less than or equal to a prescribed level; and
if an ink near-end state is detected after the printer starts printing on a written medium, the printer continues printing without unconditionally ending the printing operation, and the media transportation mechanism stores the finished medium after printing in the finished media stacker; and
if the ink end state is detected after the printer starts printing on a written medium, the printer unconditionally ends the printing operation, and the media transportation mechanism discharges the partially printed written medium from the printer to the defective media stacker.

16. The media processing device described in claim 15, further comprising:
a warning indicator that issues a warning when a printer error is detected.

17. The media processing device described in claim 15, further comprising:
a data write error detector that detects data writing errors by the media drive;
wherein the media transportation mechanism discharges write defect media from which a data write error was detected to the defective media stacker.

* * * * *